US010446967B2

(12) United States Patent
Gailus et al.

(10) Patent No.: US 10,446,967 B2
(45) **Date of Patent: *Oct. 15, 2019**

(54) CONNECTOR HAVING IMPROVED CONTACTS

(71) Applicant: Amphenol Corporation, Wallingford, CT (US)

(72) Inventors: Mark W. Gailus, Concord, MA (US); Brian P. Kirk, Amherst, NH (US); Thomas S. Cohen, New Boston, NH (US)

(73) Assignee: Amphenol Corporation, Wallinford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/025,645

(22) Filed: Jul. 2, 2018

(65) Prior Publication Data

US 2018/0316114 A1 Nov. 1, 2018

Related U.S. Application Data

(63) Continuation of application No. 15/420,973, filed on Jan. 31, 2017, now Pat. No. 10,020,607, which is a (Continued)

(51) Int. Cl.
*H01R 13/26* (2006.01)
*H01R 24/62* (2011.01)
(Continued)

(52) U.S. Cl.
CPC ..... *H01R 13/26* (2013.01); *H01R 13/6585* (2013.01); *H01R 13/6597* (2013.01); *H01R 24/62* (2013.01)

(58) Field of Classification Search
CPC .... H01R 13/26; H01R 13/6597; H01R 24/62; H01R 13/114; H01R 13/113; H01R 13/112; H01R 13/6585
(Continued)

(56) References Cited

U.S. PATENT DOCUMENTS 5,403,215 A 4/1995 Buchter et al.
5,993,259 A 11/1999 Stokoe et al.
(Continued)

FOREIGN PATENT DOCUMENTS

CN 1109222 A 9/1995
CN 102683940 A 9/2012

OTHER PUBLICATIONS

Chinese Office Action for CN Application No. 2016103276135, dated Nov. 28, 2017, 4 pages.

*Primary Examiner* — Gary F Paumen
(74) *Attorney, Agent, or Firm* — Blank Rome LLP

(57) ABSTRACT

An electrical connector for connecting a conductor of a daughter card connector wafer with a blade in the housing of a backplane connector. The daughter card conductor has a body with two elongated beams extending outward from the body. The two elongated beams each have an outer edge and an inner edge, whereby an opening is defined between the inner edges. The backplane conductor has a body with a narrowed tab portion extending outward from said second conductor body. The narrowed tab portion having outer opposite edges and is sized so that the narrowed tab portion fits between at least a portion of the outer edges of the two elongated beams, and in some cases between at least a portion of the inner edges of the two elongated beams.

16 Claims, 10 Drawing Sheets

Related U.S. Application Data continuation of application No. 14/616,157, filed on Feb. 6, 2015, now Pat. No. 9,559,468, which is a continuation of application No. 13/348,801, filed on Jan. 12, 2012, now Pat. No. 8,961,227.

(60) Provisional application No. 61/440,225, filed on Feb. 7, 2011.

(51) Int. Cl.
*H01R 13/6585* (2011.01)
*H01R 13/6597* (2011.01)

(58) Field of Classification Search
USPC ..... 439/607.05–607.16, 889
See application file for complete search history.

(56) References Cited

U.S. PATENT DOCUMENTS

| | | | | |
|---|---|---|---|---|
| 6,042,386 | A | 3/2000 | Cohen et al. | |
| 6,379,188 | B1 | 4/2002 | Cohen et al. | |
| 6,409,543 | B1 | 6/2002 | Astbury, Jr. et al. | |
| 6,503,095 | B1 | 1/2003 | Endo et al. | |
| 6,565,387 | B2 | 5/2003 | Cohen | |
| 6,592,381 | B2 | 7/2003 | Cohen et al. | |
| 6,709,294 | B1 | 3/2004 | Cohen et al. | |
| 6,764,349 | B2 | 7/2004 | Provencher et al. | |
| 6,776,659 | B1 | 8/2004 | Stokoe et al. | |
| 6,827,611 | B1 | 12/2004 | Payne et al. | |
| 7,108,556 | B2 | 9/2006 | Cohen et al. | |
| 7,494,379 | B2 | 2/2009 | Do et al. | |
| 7,581,990 | B2 | 9/2009 | Kirk et al. | |
| 8,961,227 | B2 * | 2/2015 | Gailus ..... | H01R 13/26 439/607.07 |
| 9,004,942 | B2 | 4/2015 | Paniagua | |
| 9,022,806 | B2 | 5/2015 | Cartier, Jr. et al. | |
| 9,559,468 | B2 * | 1/2017 | Gailus ..... | H01R 13/26 |
| 10,020,607 | B2 * | 7/2018 | Gailus ..... | H01R 13/26 |
| 2001/0012729 | A1 | 8/2001 | Van Woensel | |
| 2002/0123266 | A1 | 9/2002 | Ramey et al. | |
| 2011/0067237 | A1 | 3/2011 | Cohen et al. | |

* cited by examiner

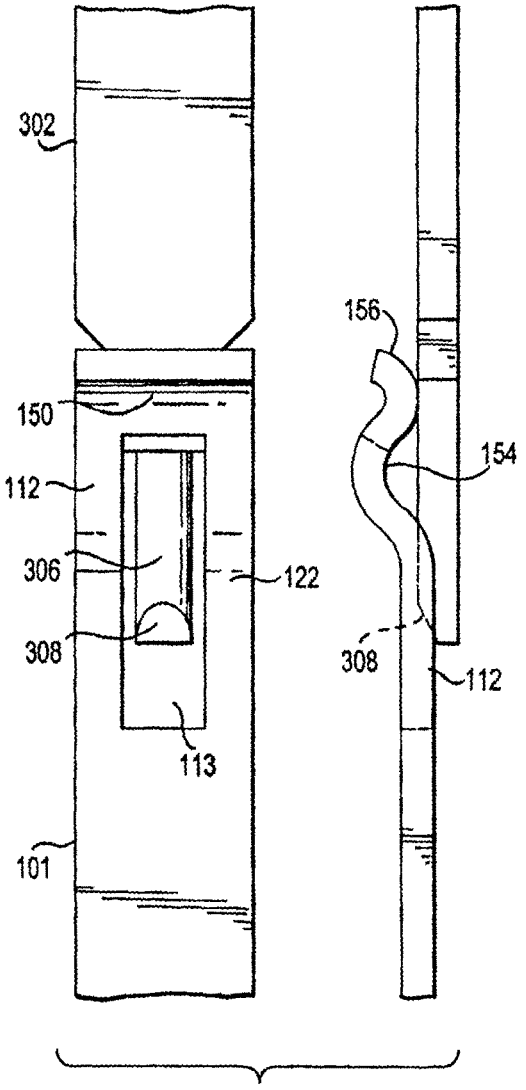
FIG. 3(c)
FIG. 3(d)
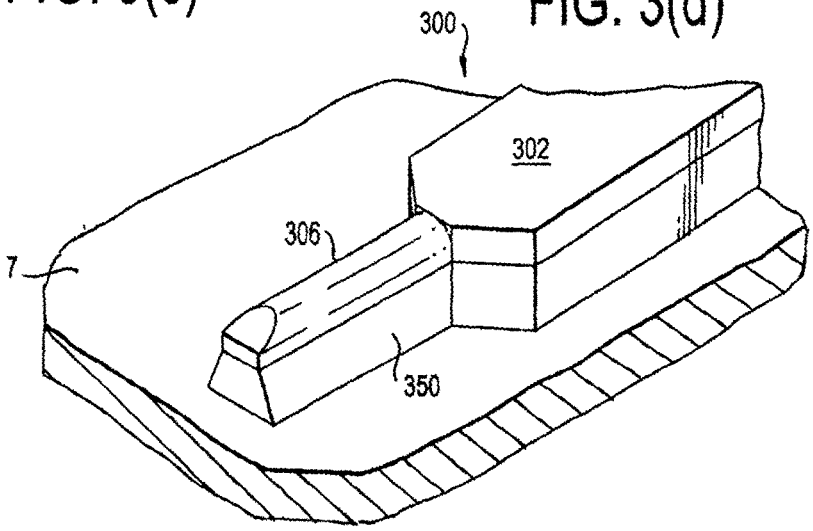

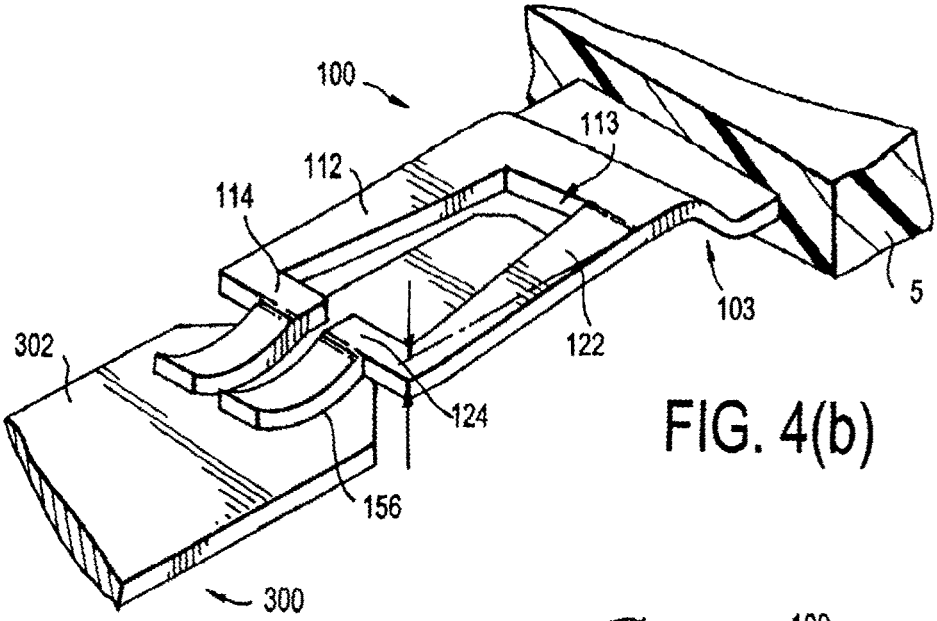
FIG. 4(b)
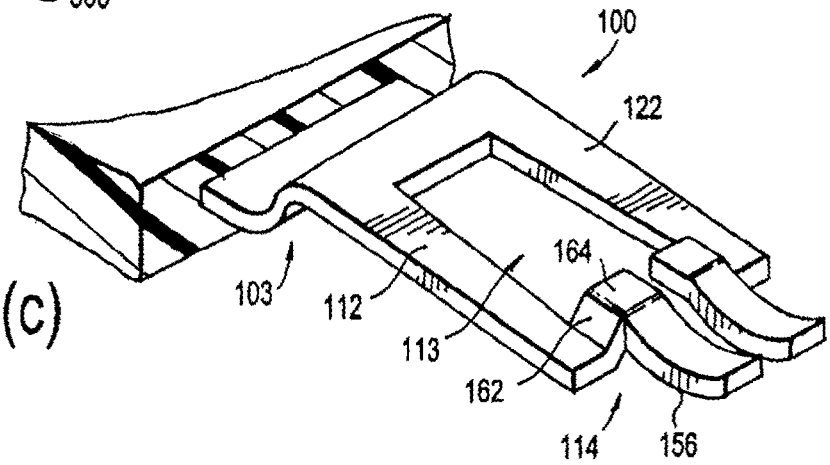
FIG. 4(c)
FIG. 4(d)
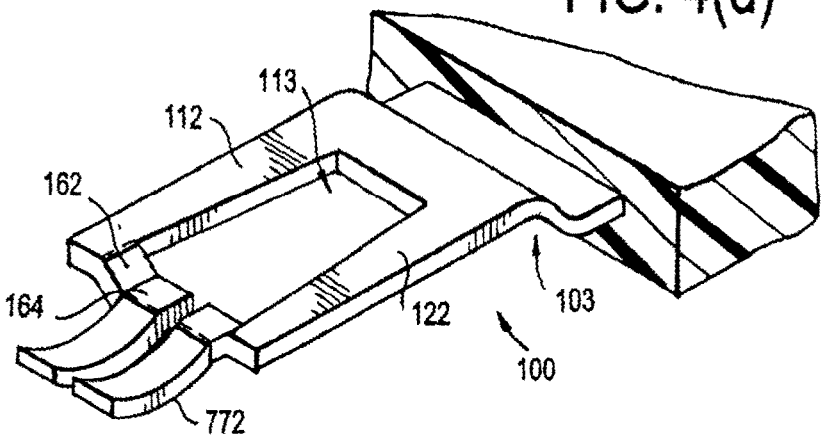

CONNECTOR HAVING IMPROVED CONTACTS

RELATED APPLICATIONS

This patent application is a Continuation of U.S. application Ser. No. 15/420,973 filed Jan. 31, 2017 (Now U.S. Pat. No. 10,020,607), which is a Continuation of U.S. application Ser. No. 14/616,157 filed Feb. 6, 2015 which is a Continuation of U.S. application Ser. No. 13/348,801 filed Jan. 12, 2012 (Now U.S. Pat. No. 8,961,277), which claims the benefit of U.S. Provisional Application No. 61/440,225, filed Feb. 7, 2011. The entire contents of those applications are incorporated herein by reference.

BACKGROUND OF THE INVENTION

Field of the Invention

The present invention relates to electrical interconnection systems and more specifically to improved signal integrity in interconnection systems, particularly in high speed electrical connectors.

Background of the Related Art

Electrical connectors are used in many electronic systems. It is generally easier and more cost effective to manufacture a system on several printed circuit boards ("PCBs") that are connected to one another by electrical connectors than to manufacture a system as a single assembly. A traditional arrangement for interconnecting several PCBs is to have one PCB serve as a backplane. Other PCBs, which are called daughter boards or daughter cards, are then connected to the backplane by electrical connectors.

Electronic systems have generally become smaller, faster and functionally more complex. These changes mean that the number of circuits in a given area of an electronic system along with the frequencies at which the circuits operate, have increased. Electrical connectors are needed that are electrically capable of handling more data at higher speeds.

One of the difficulties in making a high density, high speed connector is that electrical conductors in the connector can be so close that there can be electrical interference between adjacent signal conductors. As signal frequencies increase, there is a greater possibility of electrical noise being generated in the connector in forms such as reflections, crosstalk and electromagnetic radiation. Therefore, the electrical connectors are designed to limit crosstalk between different signal paths and to control the characteristic impedance of each signal path.

A conventional electrical interconnection system is shown in U.S. Pat. No. 7,581,990 to Kirk et al., which has been partly reproduced in FIGS. 1(*a*)-(*b*). The contents of the Kirk et al. patent are incorporated herein by reference. As shown in FIG. 1(*a*), the system includes a daughter card connector and a backplane connector. The daughter card connector has one or more connector wafers, each with electrical conductors having pin contacts at one end which connect to a PCB, dual-beam mating contacts 10, 12 at an opposite end, and an intermediate portion therebetween which connects the pin contacts to the mating contacts 10, 12. The intermediate portion is embedded in the wafer insulative housing 5, and the blades 20, 22 are embedded in the insulative housing of the backplane connector shroud. The mating contacts 10, 12 connect to the blades 20, 22 in the backplane connector.

Referring to FIGS. 1(*a*) and (*b*), the mating contacts 10, 12 include a differential pair of signal contacts 10 and ground contacts 12 on either end of the differential pair. The backplane blades have signal blades 20 and ground blades 22, which couple with the corresponding signal mating contact 10 and ground mating contacts 12, respectively. Each of the mating contacts 10, 12 include dual beams 14, 16 which have curved distal ends that couple with the backplane blades 20, 22. One advantage of this contact configuration is that the blades only need to be plated (such as with gold) on the one surface where they contact the beams and the beams do not require complex manufacturing techniques and are easier to reduce in size.

The mating contacts 10, 12 and the blades 20, 22 have a coplanar waveguide structure which guides the signals in the intermediate portion of the connector. The electrical characteristics of the daughter card and backplane conductors are controlled by the thickness of the metal (to a small extent), by the width of the signal and ground conductors 10, 12 (to a large extent), as well as by the spacing between the signal conductors 10 and the ground conductors 12, and the spacing between the two signal conductors 10 which form the differential pair. It is also influenced by the dielectric constant and the nature of the insulating materials surrounding the conductors 10, 12. It is desirable for the characteristic impedance of the signal and ground conductors 10, 12 to match the characteristic impedance of the signal and ground blades 20, 22 with which they connect. However, it can be challenging to obtain a mating interface which has a desired impedance because in the area where mating conductors 10, 12 overlap, the effective thickness of the conductors can be too great and the spacing between different conductors too narrow.

In order to ensure a reliable signal connection under actual use conditions, the blades 20, 22 must extend past the beams 14, 16 since the point of contact must slide for some distance along the blades 20, 22 to ensure that the connector is fully and reliably mated. The over-travel region of the blades 20, 22 is the portion above the point of contact at which the contacts 10, 12 mate with the blades 20, 22. The over-travel region acts like an excess capacitance at low frequencies and like a resonant stub at higher frequencies (e.g., 10 GHz and higher). In FIG. 1(*b*), the outside edges of each of the bifurcated beams are close together to be narrower than the respective mating blades, which will tend to raise the impedance of the beam region to partially compensate for the excess capacitance and the impedance-lowering characteristic of the over-travel region at frequencies below the first possibility of a stub resonance. However, because the distance between the outer edges of a blade is wider than the distance between the outer edges of the beams that mate with it, the over-travel portion of the blades couple together with each other more strongly than the outer edges of the bifurcated beams couple with each other.

Consequently, the prior art of FIGS. 1(*a*) and (*b*) do not reduce the problems of excess capacitance and resonant stub effect at higher frequencies where strong currents and charges appear in the over-travel region of the blade. The width and spacings between the various stub portions of signals and grounds affect the magnitude of that excess capacitance and the magnitude of the resonant stub effect. The blades 20, 22 are wider and more closely spaced to each other than the corresponding outer edges of the beam portions of the conductors 10, 12. This results in a deleterious effect on the electrical characteristics of the mating interface due to the stronger coupling between the stub portions of the blades. This, in turn, results in diminished signal transmission, increased signal reflection and crosstalk at the mating interface and results in diminished impedance matching. The stub does not form part of the intended path, but a parasitic path.

SUMMARY OF THE INVENTION

It is an object of the invention to preserve the electrical characteristics of the signal path along the entire length of the conductors, and especially at the mating interface where the beam conductors couple with backplane blade conductors. It is another object of the invention to achieve desired electrical characteristics by coupling the edges of the beams and decoupling the over-travel regions of the blade portions. It is a further object of the invention to make the signal conductor narrow and the spacings between the signal conductor and the ground conductors narrower and, in the intermediate portion, to have the signal and ground conductors close to one another. It is a further object of the invention to provide a mating interface with narrowed blades so that the sides of the signal blades are further away from the sides of the neighboring ground blades, and especially in an over-travel region. And, it is another object of the invention to provide a mating interface with improved impedance matching and signal transmission by means of flexible conductor beams that are wider measured from outer edge to outer edge and that connect to the narrowed blades. It is still another object of the invention to minimize the currents and charges in the over-travel region of the mating interface between the conductors and the blades. It is yet another object of the invention to provide a mating conductor with sufficient flexibility, yet is strong enough to provide a sufficient normal force to maintain a reliable connection with a blade. It is another object of the invention to provide an alternate design of a single point-of-contact beam which has the effective mechanical width and stiffness adjustable independently of the effective electrical width as determined by the distance between its extreme outer edges. It is another object of the invention to move the outer edge of the conductor outward to maintain the coupling between signal and ground conductors. It is another object of the invention to widen the outer edges of the beams and have the beams selectively spaced apart from the grounds and the other half of the differential pair independent of the blades. It is yet another object of the invention to reduce the effect of the stub by making the blades narrower.

In accordance with these and other objects of the invention, an interconnection system is provided for connecting a conductor of a daughter card connector wafer with a blade in the housing of a backplane connector. The daughter card conductor has a body with two elongated beams extending outward from the body. The two elongated beams each have an outer edge and an inner edge, whereby an opening is defined between the inner edges. The backplane conductor has a body with a narrowed tab portion extending outward from said second conductor body. The narrowed tab portion having outer opposite edges and is sized so that the narrowed tab portion fits between at least a portion of the outer edges of the two elongated beams, and in some cases between at least a portion of the inner edges of the two elongated beams.

Accordingly, the distance between the outer edges of the contact beams is wider than the outer edges of a blade which they mate with. This causes the coupling between the outer edges of the beam portions of various conductors to be stronger than the coupling between the corresponding edges of the blades in the over-travel region.

DETAILED DESCRIPTION OF THE PREFERRED EMBODIMENTS

Figure 1A:
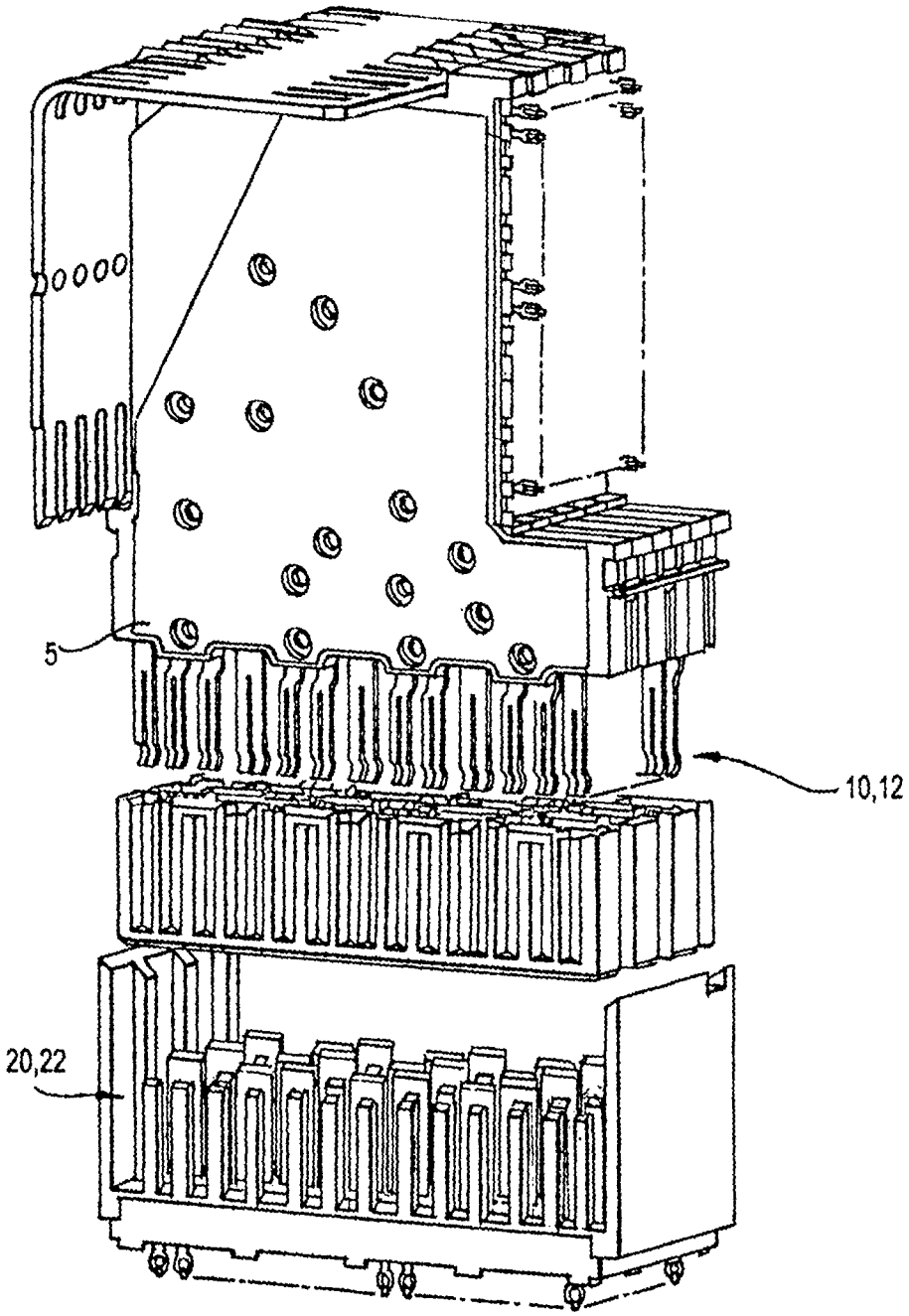
FIG. 1(a) (PRIOR ART)
FIGS. 1(*a*), (*b*) are views of a prior art system.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose.

Figure 2A:
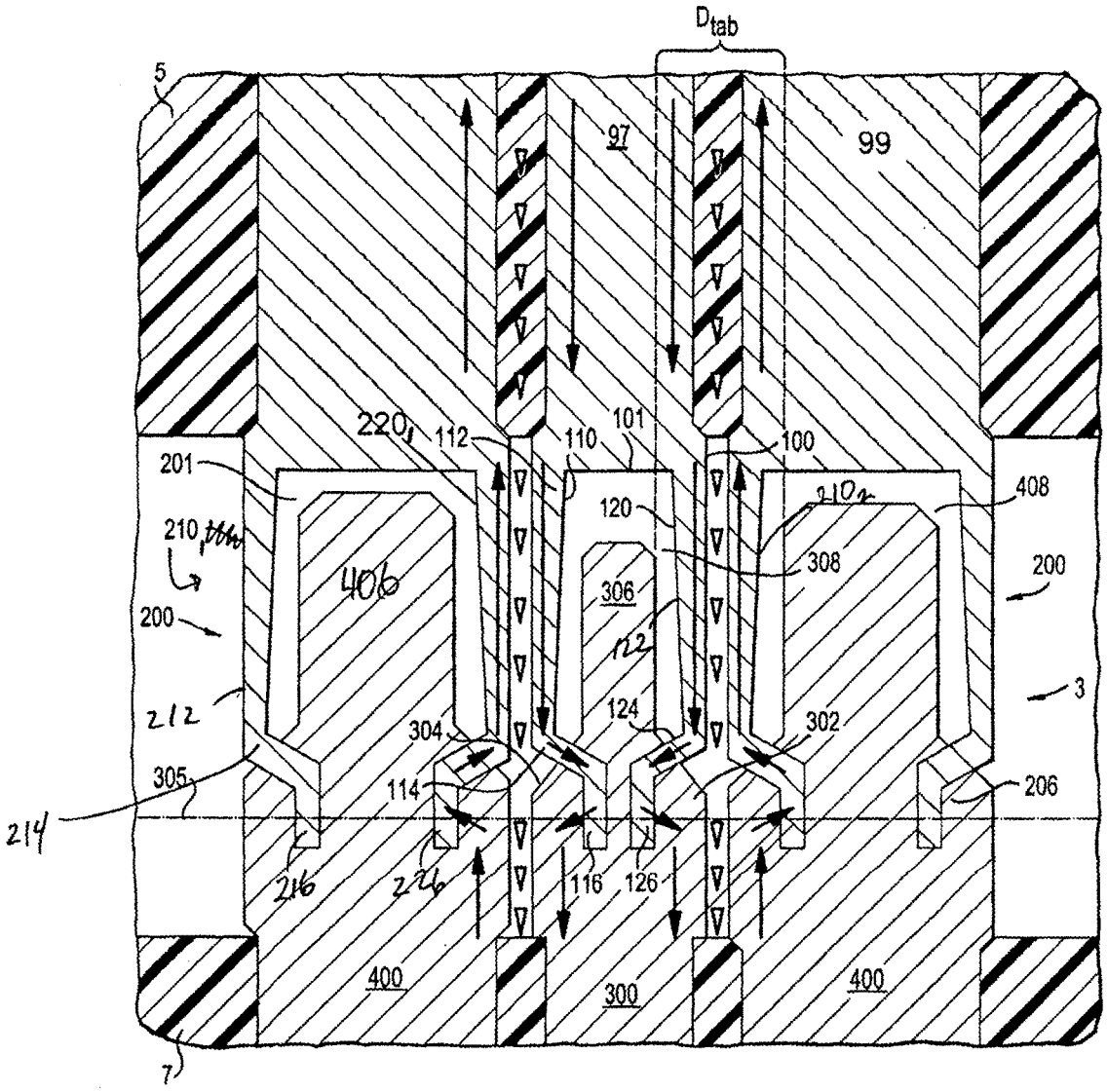
FIGS. 2(*a*), (*b*), (*c*) show improved mating interfaces in accordance with the present invention.
Figure 2B:
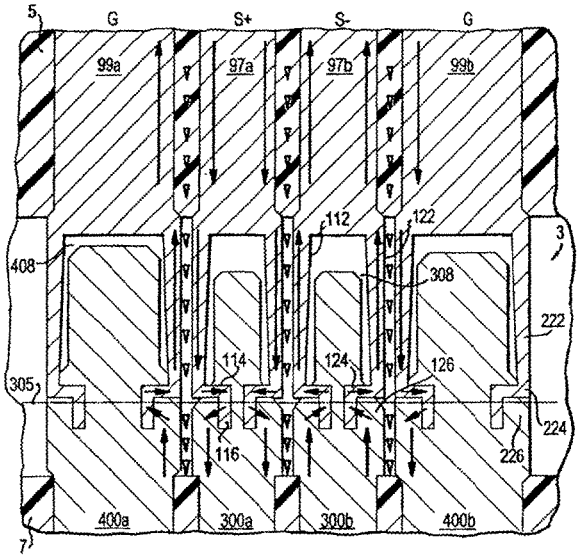
Figure 2C:
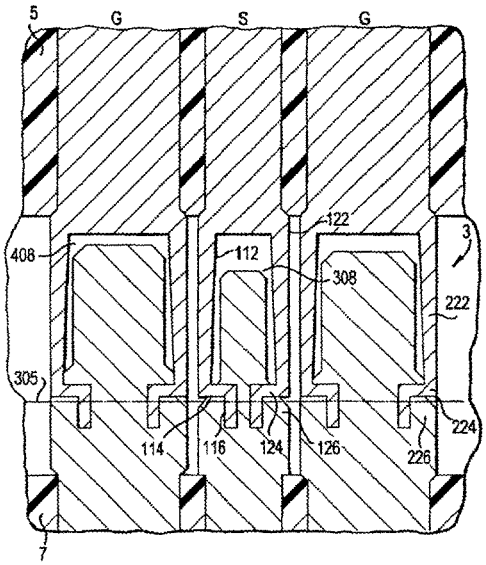

Turning to the drawings, FIG. 2(*a*) shows the mating interface 3 of an interconnection system. The separable mating interface 3 has a coplanar waveguide structure with improved electrical performance. The mating interface 3 generally includes the mating contacts or conductors 100, 200 of the daughter card connector which are coupled with the conductors or blades 300, 400 of the backplane connector. The conductors 100, 200 include signal contacts 100 and ground contacts 200 which are at a distal end section of respective intermediate portions 97, 99. The intermediate portions 97, 99 are embedded in a first insulative housing 5 of the daughter card connector. A signal blade 300 and two ground blades 400 are embedded in a second insulative housing 7 of the backplane connector. These can either be fully embedded or partially embedded with the top exposed, as long as the insulative members 5, 7 hold the contacts 100, 200 and blades 300, 400 in position.

The mating contacts 100, 200 each have two elongated flexible beams 110, 120, 210, 220. The flexible beams 110, 120, 210, 220 each have an elongated leg portion 112, 122, 212, 222, a bend 114, 124, 214, 224, and a distal end or tip 116, 126, 216, 226, which are formed as a unitary single integrated piece together with the intermediate portion 97, 99 of the conductor. The elongated leg portion 112, 122, 212, 222 extends outward (downward in the embodiment of FIG. 2(*a*)) from the proximal end of the intermediate portion of the conductor. The outside edge of the elongated leg portion 112, 122, 212, 222 is angled outward slightly at the leading surface of the insulative housing 5, so that the leg portion 112, 122, 212, 222 has a wider outer width than that of the embedded intermediate portion 97, 99 of the conductor. Thus, in order to maintain the same electrical characteristics of the embedded conductors 97, 99, the beams 110, 120, 210, 220 are wider apart and therefore also closer to the neighboring beam (i.e., signal to ground or signal plus to signal minus). By being closer, the present invention is able to maintain the characteristic impedance of a coplanar transmission structure even though the dielectric of the surrounding medium is lower.

The outside edge of the elongated leg portion 112, 122, 212, 222 is substantially perpendicular to the surface of the insulative housing 5, and parallel to the longitudinal axis of the distal end section of the intermediate portion 97, 99 of the conductor. The inside edge of the elongated leg portion 112, 122, 212, 222 is slightly angled outward from the proximal end to the distal end of the leg portion 112, 122, 212, 222. Accordingly, the leg portion 112, 122, 212, 222 is slightly tapered inward, so that it is wider at its proximal end where it is coupled with the intermediate portion 97, 99 of the conductor, and narrower at its distal end where it connects to the bend 114, 124, 214, 224. The beams 110, 120, 210, 220 each form a spring which is more rigid at the proximal end and more flexible at the distal end to more uniformly distribute the mechanical stresses. This allows the beam to be displaced a greater distance without it becoming permanently deformed.

The outer-facing edge of the beams 110, 120, 210, 220 is configured strictly by the position and spacing to the edge of the immediately neighboring beam (whether it is a ground or the other half of a signal pair) to achieve a desired electrical performance. The inner-facing edge is separately configured to provide the tapering to achieve the mechanical spring characteristics such as stiffness and resistance to plastic deformation due to overstresses.

The leg portion 112, 122, 212, 222 extends substantially perpendicular from the front face of the conductor 100, 200. The distal end of the leg portion 112, 122, 212, 222 connects with the bend portion 114, 124, 214, 224, which in turn connects with the tip 116, 126, 216, 226. The bend portion 114, 124, 214, 224 can be a straight section that is angled inwardly with respect to the leg portion 112, 122, 212, 222. Accordingly, the bends 114, 124, 214, 224 bring the tips 116, 126, 216, 226 closer to one another. That is, with respect to the signal contact 100, the tip 116 of the first leg 110 is brought closer to the tip 126 of the second leg 120. The tips 116, 126 can be elongated and substantially parallel to the longitudinal axis of the leg portions 112, 122. Accordingly, the inward bend portion 114, 124 allows for the leg portion 112, 122 to be widely set apart from one another, and the tip 116, 126 to be closer together to couple with the blade 300.

The first leg portion 112, 212 and the second leg portion 212, 222 define an opening or window 101, 201 therebetween. The window 101, 201 is slightly smaller at the proximal end than at the distal end, due to the legs 110, 120 being slightly angled outward and also being wider at the proximal end and tapering toward the distal end. The window 101, 201 provides a desired flexibility of the beams. In addition, the elongated leg portions are flexible, especially as compared with a single solid beam. The flexibility provides a reliable normal force for connection to the blade 300, 400.

The leg portions also maintain a large overall width of the mating contacts 100, 200. The signals flow on the outside edges of the leg portions 112, 122, 212, 222 (since those are closest to the neighboring signal and/or ground conductors), so that the leg portions define the effective width of the mating contacts 100, 200 in the mating region. Accordingly, by providing the window 101, 201, the conductor becomes more flexible to achieve a reliable connection to the blade 300, 400, and the width of the mating contacts 100, 200 can be maintained or even increased to provide a desired characteristic impedance for the daughter card conductors in the mating region.

In accordance with the preferred embodiment of the invention, the desired characteristic impedance is approximately 85-100 ohm differential. The width of the signal mating contact 100 is about 0.8-1.2 mm from the outside of the first leg 110 to the outside of the second leg 120. The width of the ground mating contact 200 is about 1.0-3.0 mm, from the outside of the first leg 2101 to the outside of the second leg 2201. The leg portions are about 0.2-0.3 mm wide and 2.0-4.0 mm long. The thickness of the metal of these leg portions is about 0.1-02 mm.

The blades 300, 400 are embedded in the second insulative housing 7 and extend substantially perpendicular outward (upward in the embodiment of FIG. 2(*a*)). The blades 300, 400 include a body portion 302, 402 which is angled 304, 404 inward, and a tab portion 306, 406. The body portion 302, 402 is angled slightly outward at the leading surface of the insulative housing 7, so that the body portion 302, 402 is wider than the area of the blade 300, 400 which is embedded in the housing 7. The angled portion 304, 404 is angled inwardly to define the tab portion 306, 406 which is narrowed with respect to the body portion 302, 402. Any suitable angle can be provided, though preferably about 90-150 degrees. The tab portion 306, 406 has a straight leading edge which faces, and is substantially parallel to, the leading edge of the intermediate portion 97, 99 of the daughter card conductors. In addition, as shown, the signal blades are shorter than the ground blades so that the ground blades mate with the ground conductors before the signal blades mate with the signal conductors. This allows any static electricity to discharge to ground without damaging the semiconductor. The leading edge sides 308, 408 are beveled to avoid it becoming an obstruction.

As shown, the structure and function of the signal contact 100 and signal blade 300 is similar to that of the ground contact 200 and the ground blade 400. However, the description here is with respect to the signal contact 100 and signal blade 300 for clarity, and it should be understood that a similar description applies to the ground contact 200 and ground blade 400. Accordingly, with respect to the signal contact 100 and the signal blade 300, the narrowed tab portion 306 has a width which is slightly greater than the distance between the signal contact tips 116, 126 of the mating contact 100. As the housings 5, 7 are brought together to mate, the tips 116, 126 contact the tab portion 306 and travel along the top surface of the tab portion 306 to the blade body 302. The first leg portion 112 and the second leg portion 122 are separated from each other by a distance which is greater than the width of the blade tab portion 306. The outer edges of the leg portions 112, 122 are separated by a distance which is about the same as the outer edges of the blade body 302, so that the mating contacts 100, 200 takes the same amount of space as the blades 300, 400.

The configuration of FIG. 2(*a*) allows the flexible beams 110, 120 to move upward and downward with respect to the top mating surface of the blade 300 (i.e., into and out of the embodiment of FIG. 2(*a*)). The beams 110, 120 are biased downward, so that the blade 300, 400 pushes it upward and that normal force ensures a reliable contact between the tips 116, 126 and the blade 300. The thickness of the metal conductors, mating contacts 100 and blades 300 can be uniform. The impedance is maintained in the mating interface by providing the widened distance between the outside edges of the signal beams 110, 120 and/or the widened distance between the outside edges of the ground beam 210, 220 and/or the narrowed gap between neighboring beams (e.g., ground beam 210 and signal beam 120).

Once the mating contacts 100 and blades 300 are fully mated, the tips 116, 126 contact the blade body 302 at the contact point 305. The general regions of strongest current flow are represented by the heavy arrows in FIG. 2(*a*), for a high frequency signal (e.g., with power content in the 25 GHz range). The current flows near the edges of the conductors 100 where the signal conductor 100 is closest to the ground conductors 200. The small triangles represent the general regions of highest electromagnetic power flow concentration near where the signal and ground conductors 100, 200 are closest together. Thus, for characteristic impedance matching, the width from the outside of each of the leg portions 112, 122 defines the width of the conductor 100 in the mating region. The current flow is further intended to be maintained (not disrupted) past the first stub resonance (i.e., 20 GHz and higher) in the over-travel region.

As shown by the arrows, there is a current concentration on the edges of the signal conductors where they are closest to one another. And, as shown by the small triangles, there is a corresponding region of high electromagnetic power flow in the region between the two signal paired conductors, as well as between each signal conductor and its adjacent ground conductor.

There is a possible resonance which can occur in the signal blade 300, the undesirable effects of which are reduced by the present invention. As shown by the heavy lined arrows, the current comes down from the top of the intermediate portion 97 of the signal contact 100 and travels along the edges of the signal contact 100 into each of the beams 110, 120. The current signal then continues down the leg portion 112, 122 to the angled portion 114, 124 to the tips 116, 126, where it passes to the signal blade 300. The desired path of this current is one continuing downward over the lower portion of blade 300. However, some portion of the current will divide off and travel up blade tab 306 where it is reflected from an open circuit causing a quarter-wave resonance effect.

There is also a possible resonance which can occur in the ground blade 300, but which is avoided by the present invention. As the current comes in from the bottom of the ground blades 400, it could potentially travel up the receptacle beams 210, 220 or continue on the tab portion 406 of the blade 400. If the current continues up the tab portion 406, it would hit the end of the tab portion 406, reflect back and cause a resonance reflection, a notch in frequency response, and excessive reflections. The resonance would be present in the over-travel region, namely the portion of the tab 406 from the contact point level 305 to the leading end of the tab portion 406. This resonance typically occurs somewhere between about 10-25 GHz, where the stub is one-fourth of the wavelength of the propagating signal. The current is only shown in FIG. 2(*a*) as flowing in the ground blades along the edge closest to the signal blade 300, which is typical for intermediate frequencies (about 10 MHz-5 GHz). At even lower frequencies, a current may also flow in the outer edges of the ground blades 400 which are further away from the signal blade 300, and into the respective ground beams 210.

Thus, the over-travel portions of the blades 300, 400 have undesirable effects, including that they lower impedance, have excess capacitance, and the possibility of a stub resonance. By making the tab portions 306, 406 narrower, as shown in FIG. 2(*a*), and having them couple less to other tabs and beams, they acquire less of the signal energy that is propagated in between the conductors. For example, the tab portion 306 couples less to the adjacent tab portion 406 or to beams that mate on the adjacent tab portion 406. This configuration provides a more uniform electromagnetic path in the region between adjacent beam edges of conductors 97, 99 and not one that has a strong coupling to the over-travel stubs formed by tabs 306, 406. For example, the signal beam 120 and the ground beam 2102 provide a more attractive path for the electromagnetic wave to follow, as compared to tab portions 306, 406. However, narrowed tab portions 306, 406 provide a certain amount of contact mating wipe or over-travel, so that there is still a connection made even if the connector is not fully mated.

Thus, the invention has a narrow blade tab portion 406 and beams 110 that have outer edges which are further apart than the outer edges of the tab portion 406. This reduces the undesirable effects of the stub including any tendency to lower the impedance, reduce capacitance and produce a stub resonance. The wide beam edges couple more uniformly to the adjacent conductors and maintain the desired characteristic impedance of the signal transmission path. The widely spaced pairs of beams associated with each conductive path also operate to provide electromagnetic shielding of the tab over-travel region from the signals traveling along the desired signal transmission paths.

The invention provides a narrowed tab portion 306, 406, closer tips 116, 126, 216, 226 having closer points of contact 305, and further edges of beams 110, 120, 210, 220. As a result, the signal transfer from the mating contacts 100, 200 to/from the blades 300, 400 are better coupled to the other half of the differential pair or the ground, and an extended frequency response is achieved without a notch and with lowered reflection or return loss.

The blades 300, 400 have better performance and minimize the tab portion 306, 406 forming a resonant stub. The width and spacing to ground of the tab portion 306, 406 is selected to provide the desired characteristic impedance for the conductor of the mating contacts 100, 200. By narrowing the tab portion 306, 406, any undesirable effect of the over-travel region producing too low of impedance (i.e., excess capacitance), a potential to become a resonant stub is minimized, and there is less loss of transmitted energy. The width of the blade body 304 can be adjusted to obtain a desired impedance and coupling, as well as to achieve desired coplanar wave guide transmission line geometry. A wider blade body 304 also provides a greater area for the beams to mate on.

In addition, the narrowed tab portions 306, 406 provides a greater distance $D_{tab}$ between the facing edges of the adjacent tab portions 306, 406. As the distance $D_{tab}$ increases, the coupling between the tab portions 306, 406 is reduced. At frequencies below stub resonance (approximately 0-5 GHz), substantial current does not go into the stub since the current entering the stub is effectively cancelled by current reflected by the open end of the stub with no appreciable phase delay. In accordance with one preferred embodiment of the invention, the ground blade body 402 has a width of about 2.0 mm and the ground blade tab 406 has a width of about 0.8 mm, though the width of the body 402 can be 1.5-4 times greater than the width of the tab 406. The signal blade body 302 has a width of about 1.0 mm and the signal blade tab 306 has a width of about 0.7 mm, though the width of the body 302 can be 1.5-3 times greater than the width of the tab 306.

FIG. 2(*b*) shows the mating interface for a differential pair of signal conductors 97*a, b* and signal blade conductor 300*a, b*. The differential pair of signal conductors are adjacent to one another with the ground conductors on the sides (so that there is a ground conductor, signal conductor, signal conductor, ground conductor). As shown, the current travels from one of the blade conductors 300*b* (the negative signal conductor in the embodiment shown) up into the signal conductor 97*b*. The current in the adjacent ground conductor 400*b* travels in an opposite direction on the adjacent beam, i.e., from the daughter card ground 99*b* to the backplane ground conductor 400*b*. And, the current flows in the opposite direction in the other conductor 300*a*, 97*a* of the differential pair. That is, the current flows from the daughter card conductor 300*a* to the backplane conductor 97*a*. And, the current travels upward from the backplane ground conductor 400*a* to the daughter card ground conductor 99*a*. This desirable pattern of currents for uniform power flow is achieved by controlling the spacing between adjacent signal and ground conductors or positive and negative conductors at their edges. In an analogous fashion to the single-ended signal mating interface shown in FIG. 2(*a*), the signal and ground over-travel stubs are less coupled to each other and effectively shielded from the desired transmission path of electromagnetic energy, thereby reducing the undesirable effects of that stub over-travel tab.

These directions of current at each successive cross-sectional level of the signal propagation path (where the cross-section is taken perpendicular to the direction of desired signal power flow) represent the relative sign of the phase or magnitude of the currents associated with the desired unidirectional electromagnetic propagation of signal power. For an impulse, these would represent the relative signs of currents on the various conductors as the pulse passes a given cross-sectional level. In the case of an undesirable stub resonance, there will typically be undesirable out-of-phase current flow in the over-travel regions of the blades which correspond to power flowing in and out of the stub region (here acting as an electrical reactance element) in contrast to power flowing in a desired unidirectional manner from the daughter card to the backplane or vice versa.

FIG. 2(*c*) shows an alternative embodiment of the mating interface 3, in which the leg bend portions 114, 124, 214, 224 of the flexible beams 110, 120, 210, 220 are substantially formed at a right angle to the longitudinal axis of the leg portions 112, 122, 212, 222, and also at a right angle to the tips 116, 126, 216, 226. It should be noted that the bend portion can have any suitable angle with the leg portions and the distal end portions. In addition, though the longitudinal axis of the distal end portions are shown to be substantially parallel to the longitudinal axis of the blades 300, 400 or the intermediate portions 97, 99 of the conductors, any suitable angle can be used. And, the bend 114, 124 of the signal contact 100 can have a different angle than the bend 214, 224 of the ground contact 200, and/or the first bend 114 can have a different angle than the second bend 124. Generally, a longer bend increases the torsional force in the beam, which increases flexibility.

Figure 3A:
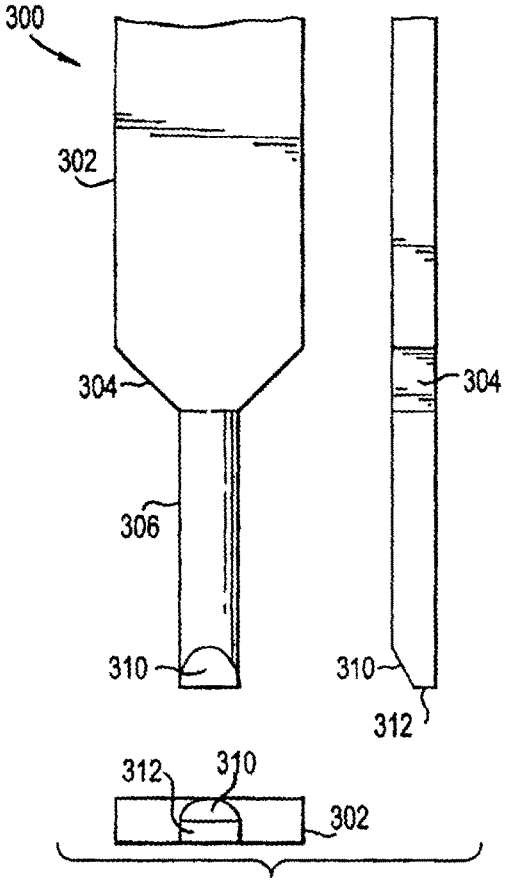
FIGS. 3(*a*), 3(*b*), 3(*c*), 3(*d*), 4(*a*), 4(*b*), 4(*c*), 4(*d*), 5(*a*), 5(*b*), 5(*c*) show conductors and blades in accordance with alternative embodiments of the invention; and, FIGS. 6(*a*), (*b*) show plots illustrating the improvement to the signal loss.
Figure 3B:
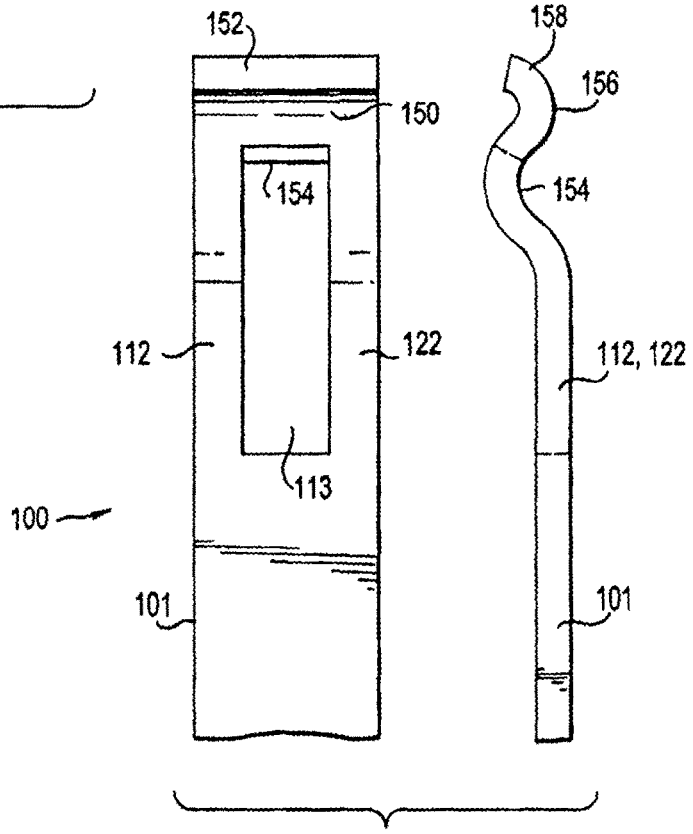

FIG. 3(*a*) is an alternative embodiment of the blades 300, 400 of FIGS. 2(*a*), (*b*), (*c*), though only a single signal blade 300 is shown for ease of illustration. The blade 300 is shown from a top view (the top left part of FIG. 3(*a*)), a side view (the embodiment on the right of FIG. 3(*a*)), and a front view of the leading edge (the bottom embodiment in FIG. 3(*a*)). The blade 300 is narrower in the mating interface by providing a wide body portion 302 which reduces in width at an angled portion 304 and leads to an elongated narrow tab portion 306. As shown in the bottom figure, the body portion 302 is relatively flat to have a substantially rectangular cross-section, whereas the tab portion 306 is substantially curved to for a half-cylindrical semi-circular cross-section. The top portion of the leading edge 310 of the tab portion 306 is chamfered to form a chamfered tip portion 308.

FIG. 3(*b*) is an alternative embodiment of the mating portion of the conductors of FIGS. 2(*a*), (*b*), (*c*) for use with the blades 300, 400 of FIG. 3(*a*), though only the signal contact 100 is shown for ease of illustration. Here, the body portion 101 of the signal contact 100 is at least partly imbedded in an insulative housing (not shown). The mating portion of the signal contact 100 includes two flexible beams 110, 120 with elongated leg portions 112, 122 which extend substantially parallel to one another and perpendicular to the leading edge of the body portion 101. A cross-support member 150 is provided at the distal end of the signal contact 100, which connects the two distal ends of the leg portions 112, 122. The cross-support member 150 provides greater stability at the distal end of the signal contact 100, yet doesn't make the conductor too stiff as to be unable to flex when engaging the blade 300. The body 101, leg portions 112, 122, and cross-support member 150 define a window 113 therebetween. As shown by the embodiment on the right, the distal ends of the leg portions 112, 122 are curved upward then, together with the cross-support member 150, form an inverse curve 154 downward. The cross-support member 150 has a second inverse curve with a contact point 156 upward, so that the leading edge 158 of the conductor faces upward with respect to the blade 300 with which it will mate. The flexible leg portions 112, 122 act together as a single beam element whose effective electrical width is determined by the distance between the extreme outer edges is independently adjustable from its mechanical stiffness as determined by the combined actual width of the individual legs. The effective electrical width can be tuned without change to the stiffness of the leg portions 112, 122.

Turning to FIG. 3(*c*), the blade 300 and signal mating contact 100 of FIGS. 3(*a*), (*b*) are shown being mated. When the blade 300 and signal contact 100 are to be mated, the respective daughter card and backplane housings 5, 7 are brought together. As the blade 300 approaches the signal contact 100, the distal end 156 of the signal contact 100 contacts the chamfered portion 308 at the distal end 310 of the blade 300. The blade 300 remains at a fixed position, and pushes the flexible beams 110, 120 upward. As the housings 5, 7 continue to be moved closer together, the contact point 156 of the signal contact 100 slides along the top surface of the tab portion 306. When fully mated, the cross-support member 150 can rest on the proximal end of the tab portion 306 (as shown), or on the body portion 302 of the signal contact 100.

Since the tab portion 306 is cylindrical in shape, and the contact point 156 is curved, the mating interface between the blade 300 and the signal contact 100 is a crossed rods configuration. This crossed rods configuration provides a very well defined and reliable point of contact between the two elements. In addition, the signal contact 100 only connects with the blade 300 at a single contact location which is approximately in the middle of the width of the blade 300 and signal contact 100. Accordingly, the tab portion 306 is substantially narrow in width, while the width of the signal contact 100 is large.

Figure 4A:
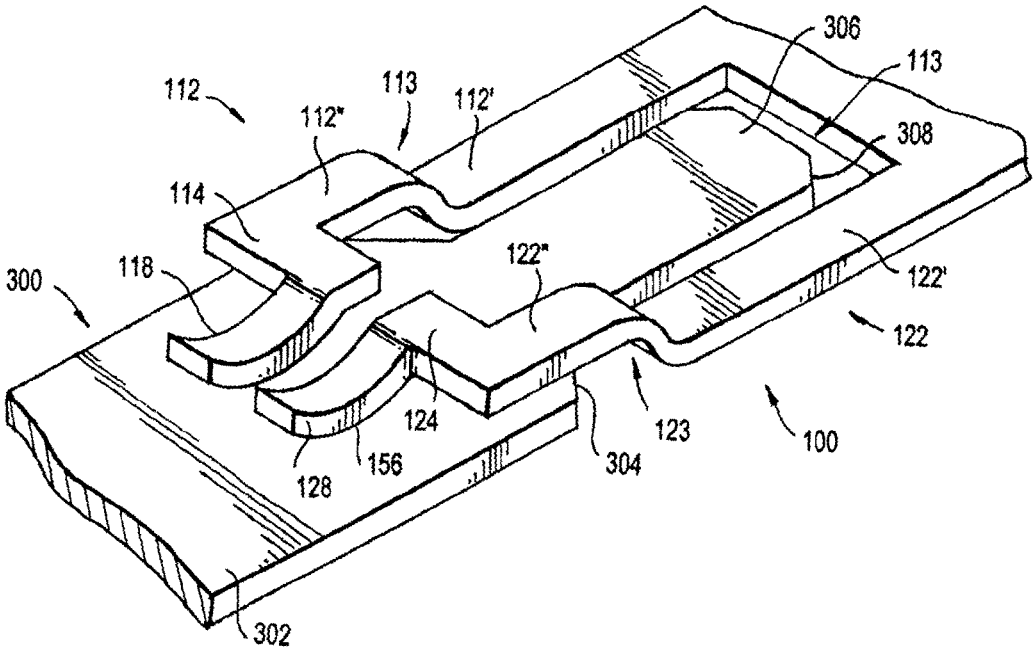

As also shown in FIG. 3(*c*), the leading section of the tab portion 306 of the blade 300 at least partially enters into the window 113 of the signal contact 100. In particular, the right embodiment shows that the tab portion 306 at least partly overlaps with the leg portions 112, 122. Thus, the leg portions 112, 122 provide enhanced electromagnetic shielding of the tab portion 306 since the leg portions 112, 122 are wider (at their inner edges) than the tab portion 306. The tab portion 306 can be completely within the window 113, as also illustrated in the embodiment of FIG. 4(*a*).

FIG. 3(*d*) shows another alternative for the blade 300 of FIG. 3(*a*). In this embodiment, the blade 300 is mounted to an insulative pedestal or base 350, which is mounted to an insulative support 7. The base 350 supports the tab portion 306 so that the tab portion 306 does not flex when contacted by the signal contact 100. The base 350 also raises the blade 300 upward off of the planar surface of the insulative support 7 so that there is sufficient room for the signal contact 100 to mate with the blade 300. It provides additional space so that the leg portions 112, 122 can overlap with the tab portion 306 without obstruction from the insulative support 7.

FIGS. 4(*a*)-(*d*) show alternative embodiments for the mating contacts 100, 300, though only the signal mating contact 100 is shown for ease of illustration. FIG. 4(*a*) is similar to FIG. 2(*c*), but the leg portion 112, 122 includes an upward curve 123 which raises the distal end of the leg portion 112, 122. Accordingly, a first leg section 112', 122' overlaps with, and can be substantially coplanar with, the tab portion 306 of the blade 300 so that the tab portion 306 is fully within the window 113. A second leg section 112", 122" is raised up to extend over the body portion 302 of the blade 302. In this manner, the distal ends 118, 128 can press down on the blade body 302 to maintain a reliable contact therewith. At the same time, the first leg section 112', 122' is aligned with the tab portion 306 to have a stronger (more complete) shielding of the tab portion 306 by the beams leg sections 112', 122'.

FIG. 4(*b*) is substantially similar to FIG. 2(*c*), but includes a bend or step 103 in the body 101 of the signal contact 100. Thus, FIGS. 4(*a*) and 4(*b*) are similar to one another, except that FIG. 4(*a*) includes a bend 123 in the leg portions 112, 122, and FIG. 4(*b*) includes the step 103 in the body portion 101. FIGS. 4(*c*), (*d*) are similar to FIG. 4(*b*), except here the step 103 is more pronounced. In addition, the leg portions 112, 122 are angled downward toward the blade 300, whereas in FIGS. 4(*a*), (*b*) the leg portions 112, 122 are substantially level with respect to the body 101 of the conductor. Also, the bend 114, 124 can have an upward (FIG. 4(*c*)) or downward (FIG. 4(*d*) ramp 162 and a platform 164. The tips 116, 126 extend downward from the platform 164 to mate with the blade 300. The wider spacing of the leg portions 112, 122 in FIGS. 4(*b*), (*c*) and (*d*) also provide enhanced electromagnetic shielding of the tab portion of the blade 300.

As can been seen, some of the windows 113 are substantially rectangular in shape so that the width of the window 113 is uniform, such as shown in FIGS. 3(*b*)-(*c*) and 4(*a*). In comparison, other windows 113 are angled, so that they are narrower at the end closest to the conductor insulative housing 5 and wider at the opposite end, as shown in FIGS. 2(*a*)-(*c*), 4(*b*)-(*d*). For the angled windows 113, the blade tab portion 306 passes under the window 113 and not into the window 113. But, mechanically the rectangular window 113 is more sensitive to tolerances because the blade tab portion 306 has to fit within the window 113 comfortably. FIGS. 2-4 show the wide applicability of the invention. The shielding which is utilized in a given application can depend on the desired width of the beams, tab portion and other size constraints.

Figure 5A:
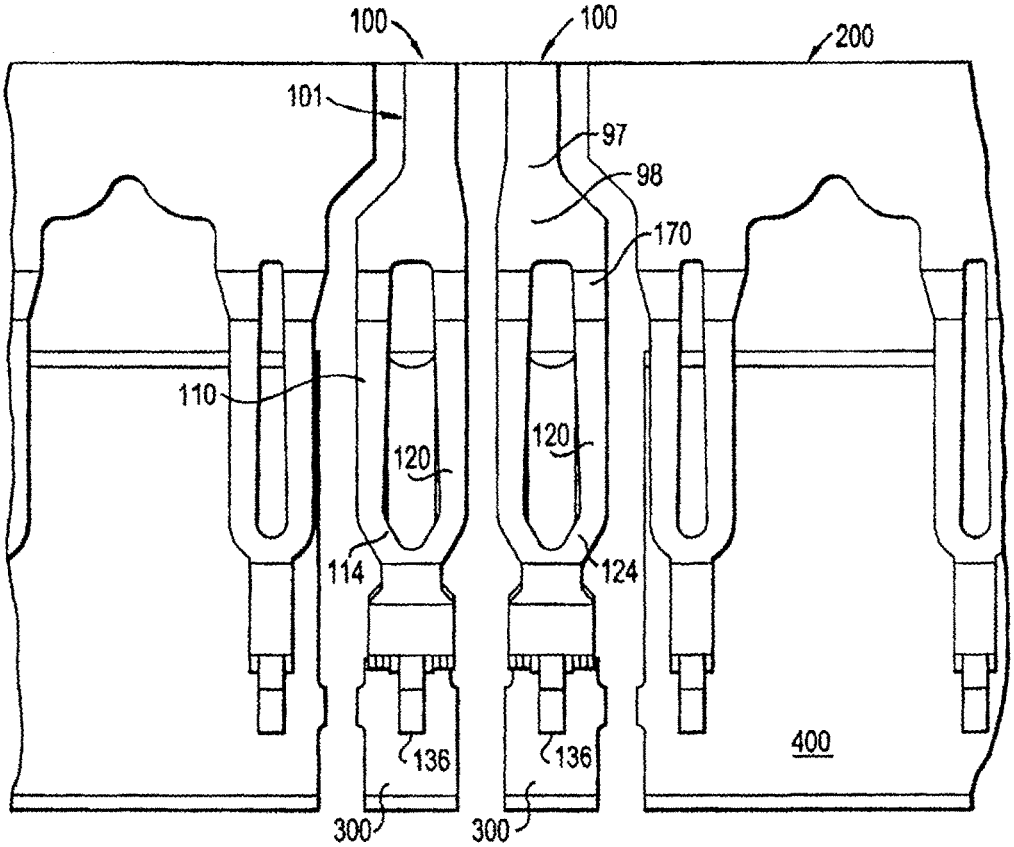
Figure 5B:
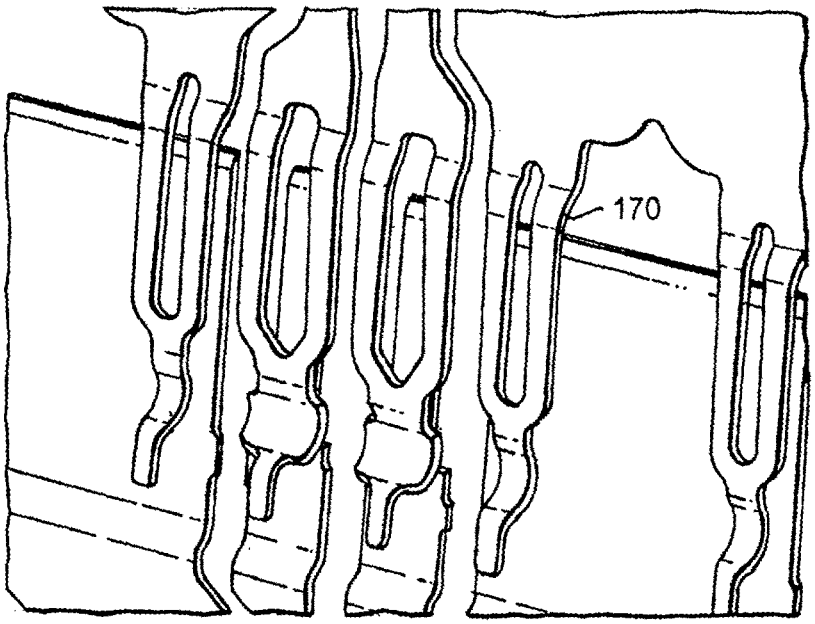
Figure 5C:
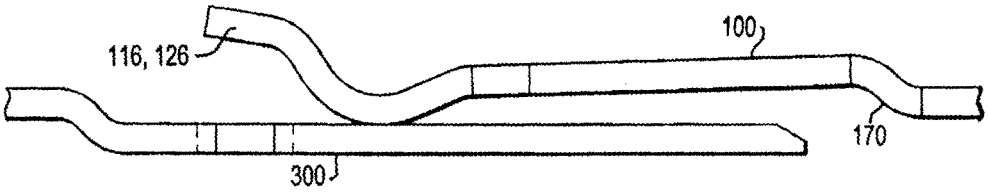

FIGS. 5(*a*)-(*c*) show another embodiment of the invention having differential signal contacts 100. Each of the signal contacts 100 has a body portion 101 which has an intermediate portion 97 with a wide head 98. The leg portions 110, 120 extend from the head 98, and have an upward (away from the blade) step 170, then a gentle slope downward. As best shown in FIG. 5(*a*), the leg portions 110, 120 are placed so that their outer edges (and in the embodiment shown, at least a substantial portion of the inner edges) are wider than the tab portion 306, so that they provide some electromagnetic shielding of the tab portion 306.

However, referring to FIG. 5(*c*), the tab portion 306 is below the leg portions 110, 120, so that the window 113 does not receive the tab portion 306, which allows for greater mechanical tolerance in the mating of the contacts 100, 200 to the blades 300, 400. The tips 116, 126 are narrow, and can mate with a stop in a wafer housing to have a preload force, such as shown and described in U.S. patent application Ser. No. 13/214,851 to Philip Stokoe which is hereby incorporated by reference. Comparing FIGS. 5(*a*) and 2(*a*), the bottom of the bend portions 114, 124, 214, 224 can be joined together as in FIG. 3(*b*). Thus, the leg portions or beams 110, 120, 210, 220 of the signal and ground conductors 100, 200 have a single tip 136 and a central longitudinal slot.

Accordingly, as shown in the illustrative embodiments of FIGS. 2-5, it is preferred that the beams 110, 120, 210, 220 have leg portions 112, 122, 212, 222 with outer edges which are wider apart than the outer edges of at least a portion of the over-travel region of the blade 300, 400 with which it mates. The outside of the beams control the flow of current, so the inside edge can be changed without significantly affecting electrical performance. In other preferred embodiments, the inner edges of the leg portions can be wider than at least a portion of the over-travel region of the blade 300, 400 (e.g., FIG. 5*a*); and in still other preferred embodiments (e.g., FIG. 2*a*, 2*b*, 3*c*, 4*a*, etc.), the outer and inner edges of the leg portions are wider than the entirety of the over-travel region of the blade 300, 400. Preferably, however, the distance between the central longitudinal axes of the legs is greater than the outer edges of the tab 306 of the blade 300, 400. As used here, the over-travel region generally refers to the portion of the blade 300, 400 from where the mating contact 100, 200 contacts the blade 300, 400, to the leading edge of the blade 300, 400. That generally includes most if not all of the tab portion 306, 406, and could also include a part of the body portion 302, 402.

In addition, the excess capacitance of the stub is reduced by making the blades narrower at the over-travel region, i.e., the tab portion 306. And, the signal is spaced further from the grounds and the complementary signal half to decrease undesirable capacitance. This provides a more ideal transmission line geometry, as shown by the current line arrows and the electromagnetic field power propagation triangles in FIG. 2(*a*).

Figure 1B:
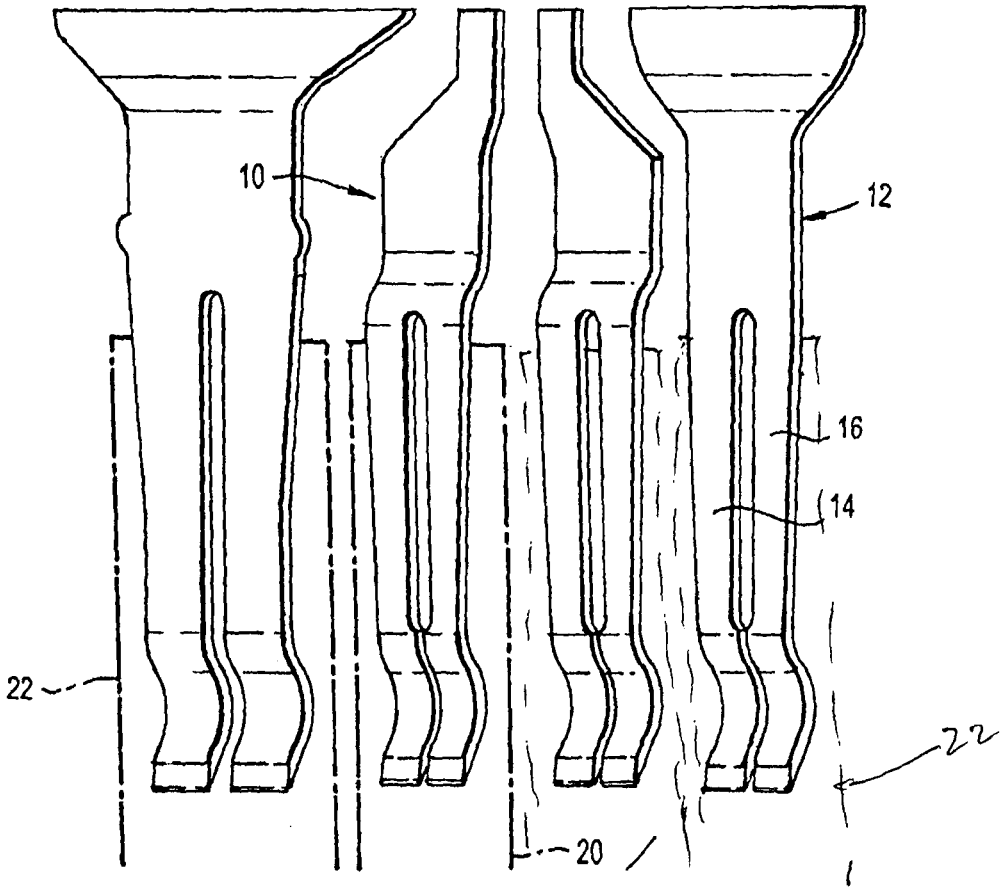
FIG. 1(b) (PRIOR ART)
Figure 6A:
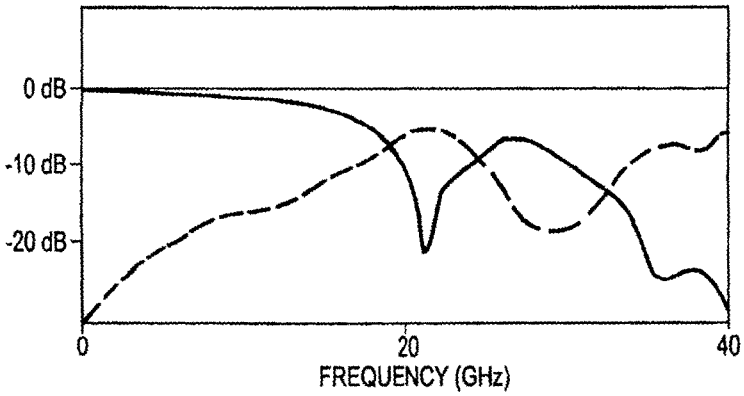
FIG. 6(a) (PRIOR ART)
Figure 6B:
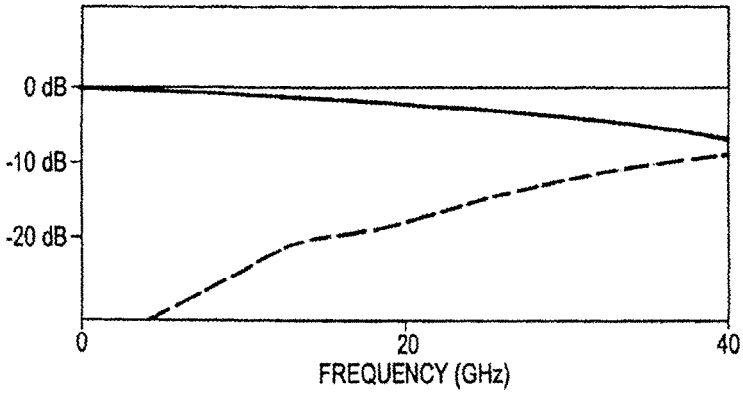

Turning to FIG. 6(*a*), a plot is shown which represents the power being transmitted through a connector incorporating the conventional mating interface of FIGS. 1(*a*)-(*b*). Here, the solid line represents the power which is transmitted versus frequency, and the dotted line is the return loss representing power reflected versus frequency. There is good transmission of no more than 2 db loss, and low return loss which is less than −15 db up to approximately 15 GHz. However, performance degrades as it approaches about 20 GHz, due to a resonance problem in the over-travel region of the mating contact interface. The resonance of the over-travel portion of the blade mating with a narrow bifurcated receptacle contact simultaneously causes reflected power to increase to −5 db, while the remaining power to be transmitted drops to form a sharp null of −20 db. Above that resonance, performance improves briefly until further mismatches cause degradation.

In contrast to FIG. 6(*a*), FIG. 6(*b*) is a plot of the behavior for a connector incorporating the improved mating interface of the invention of FIGS. 2-5. Here, the power transmitted (i.e., the solid line), remains substantially even over the entire frequency range of 0-40 GHz, and less than 2 db insertion loss from zero to past 20 GHz. And, the return loss (i.e., the dashed line) has a slow and steady rise to past 20 GHz and shows no sharp high return loss peaks over this frequency range.

The present invention provides a reduction of transmission loss and undesirable signal reflection due to mismatches and resonance effects in the mating interface of connectors. Though the invention is preferably utilized for higher frequencies (MHz and higher), it could also be used for lower frequencies. The mating interface can be provided for single or differential pair conductors. It can be formed through conventional stamping techniques. The present invention is applicable for use with blades that require gold plating on only one portion of a surface for defining a contact wipe area.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. An electrical connector assembly comprising:

a first conductor with a body and two elongated beams extending outward from said first conductor body, said two elongated beams each having an outer edge and an inner edge opposite to the outer edge; and a second conductor with a body and a tab portion extending outward from the second conductor body, said tab portion having outer opposite edges;

wherein said two elongated beams each having a proximal end connected to the first conductor body, a distal end connected to the second conductor, and an intermediate portion therebetween;

wherein the intermediate portion is curved upward with respect to the proximal end and each of the distal end is curved downward to contact the second conductor body; and wherein said tab portion fits between at least a portion of the outer edges of said two elongated beams.

2. The electrical connector assembly of claim 1, wherein each of the distal end comprises a bend section which is turned inward toward an opening between the inner edges of the two elongated beams, and a tip end extending from the bend section outward from the first conductor body, wherein the tip end is curved downward to contact the second conductor body.

3. The electrical connector assembly of claim 2, wherein the tip ends of the two elongated beams are substantially parallel to the intermediate portions of the two elongated beams.

4. The electrical connector assembly of claim 1, wherein the tab portion fits entirely within an opening between the inner edges of the two elongated beams.

5. The electrical connector assembly of claim 1, wherein the width of the tab portion of the second conductor is shorter than the width of the second conductor body.

6. The electrical connector assembly of claim 1, wherein the width of a distal end of the tab portion is shorter than the width of a proximal end of the tab portion connected to the second conductor body.

7. The electrical connector assembly of claim 1, wherein the distance between the inner edges of the proximal ends of the two elongated beams is shorter than the distance between the inner edges of the intermediate portions of the two elongated beams.

8. An electrical connector assembly comprising:

a first conductor with a body and two elongated beams extending outward from said first conductor body, said two elongated beams each having an outer edge and an inner edge opposite to the outer edge; and a second conductor with a body and a tab portion extending outward from the second conductor body, said tab portion having outer opposite edges;

wherein said two elongated beams each having a proximal end connected to the first conductor body, a distal end connected to the second conductor, and an intermediate portion therebetween;

wherein the first conductor body having a proximal end connected to an insulating housing of the first conductor and a distal end connected to the proximal ends of the two elongated beams;

wherein the distal end of the first conductor body is curved upward with respect to the proximate end of the first conductor body;

wherein each of the distal end of the two elongated beams is curved downward to contact the second conductor body; and wherein said tab portion fits between at least a portion of the outer edges of said two elongated beams.

9. The electrical connector assembly of claim 8, wherein the distance between the outer edges of the tab portion is shorter than the distance between the outer edges of the two elongated beams.

10. The electrical connector assembly of claim 8, wherein each of the distal end of the two elongated beams comprises a bend section which is turned inward toward an opening between the inner edges of the two elongated beams, and a tip end extending from the bend section outward from the first conductor body, wherein the tip end is curved downward to contact the second conductor body.

11. The electrical connector assembly of claim 10, wherein each of the bend section is curved upward.

12. The electrical connector assembly of claim 10, wherein each of the bend section is curved downward.

13. The electrical connector assembly of claim 8, wherein the tab portion fits in at least a portion of an opening between the inner edges of the two elongated beams.

14. The electrical connector assembly of claim 8, wherein the width of the tab portion of the second conductor is shorter than the width of the second conductor body.

15. The electrical connector assembly of claim 8, wherein the width of a distal end of the tab portion is shorter than the width of a proximal end of the tab portion connected to the second conductor body.

16. The electrical connector assembly of claim 8, wherein the distance between the inner edges of the proximal ends of the two elongated beams is shorter than the distance between the inner edges of the intermediate portions of the two elongated beams.

* * * * *